United States Patent [19]

Jamieson

[11] Patent Number: 4,938,395

[45] Date of Patent: Jul. 3, 1990

[54] MOUTHPIECE FOR BOTTLES AND THE LIKE

[76] Inventor: James M. Jamieson, Box 2336, New Liskeard, Ontario, Canada, P0J 1P0

[21] Appl. No.: 295,400

[22] Filed: Jan. 10, 1989

[30] Foreign Application Priority Data

May 20, 1988 [CA] Canada ..... 564559

[51] Int. Cl.[5] ..... B65D 23/06

[52] U.S. Cl. ..... 222/478; 222/545; 215/100 R

[58] Field of Search ..... 222/478, 481, 545, 479, 222/481.5; 215/11.1, 11.5, 100 R, 228, 321

[56] References Cited

U.S. PATENT DOCUMENTS

| | | | |
|---|---|---|---|
| 618,363 | 2/1949 | Clayton et al. | 222/478 |
| 1,243,963 | 10/1917 | Moser | 215/100 R |
| 1,341,826 | 6/1920 | Stewart | 215/100 R |
| 1,811,113 | 6/1931 | Derby | 210/515 |
| 2,107,309 | 2/1938 | Smith | 215/228 |
| 2,311,763 | 6/1940 | Lanfare | 222/478 |
| 2,435,033 | 1/1948 | Campbell | 215/100 R |
| 2,738,105 | 3/1956 | Wolfer et al. | 222/481.5 X |
| 2,804,242 | 8/1957 | Borah | 222/478 |
| 3,966,099 | 6/1976 | Sanford, Jr. et al. | 222/478 |

FOREIGN PATENT DOCUMENTS

| | | |
|---|---|---|
| 74008 | 12/1901 | Canada . |
| 133586 | 6/1911 | Canada . |
| 279896 | 5/1928 | Canada . |
| 295103 | 11/1929 | Canada . |
| 828572 | 12/1969 | Canada . |

*Primary Examiner*—Michael S. Huppert

*Attorney, Agent, or Firm*—Hoffman, Wasson, Fallow & Gitler

[57] ABSTRACT

A mouthpiece is designed to facilitate direct human consumption of liquid from a narrow-necked container, such as a bottle having a mouth defined by a peripheral rim that in use is enclosed by the lips of the consumer. The mouthpiece comprises a tubular body that engages the peripheral rim of the bottle mouth and forms an annular seal therewith and an adjoining extension that defines an annular wall projecting axially to surround the container adjacent its mouth. Vent passages in the mouthpiece communicate between an interior outlet receiving a tube for opening to the interior of the container, and an exterior inlet located on the surface of the mouthpiece at a position spaced from said free end by a distance sufficient to ensure that in use the inlet will not be blocked by the lips of the consumer and air can pass therethrough to the interior of the container to replace the liquid being consumed. The mouthpiece mounting section that engages around the outer surface of the peripheral rim of the bottle mouth is of compliant resilient material adapts readily to the form of the outer surface.

7 Claims, 1 Drawing Sheet

MOUTHPIECE FOR BOTTLES AND THE LIKE

BACKGROUND OF THE INVENTION

A. Field of Invention

This invention relates to a new or improved mouthpiece for use with bottles and the like to accelerate the flow of liquid from the bottle when a consumer drinks directly from the bottle.

B. DESCRIPTION OF PRIOR ART

As is well known, when a consumer drinks directly from a bottle by insertion of the neck of the bottle into the mouth of the consumer and inverting the bottle, the flow of liquid from the bottle is not continuous since air must be allowed to enter the bottle to replace the liquid that has been consumed. One device designed for this purpose is shown in Campbell U.S. Pat. No. 2,435,033 and comprises a tubular accessory that can be inserted into the neck of the bottle, and forming a tubular extension for insertion in the mouth of the consumer so that the consumer's lips are separated from the mouth of the bottle, and in the region of this separation the tubular accessory is formed with a peripheral row of small holes or slots through which air can enter the bottle as liquid is being consumed. The holes or slits are of sufficiently small size that liquid does not leak from them.

SUMMARY OF THE INVENTION

The present invention aims to provide a mouthpiece for use as an aid in drinking from bottles and the like, the mouthpiece having a configuration that is generally similar to that of the bottle to which it is applied and which incorporates an internally concealed vent system to allow entry of air into the bottle to replace the liquid being consumed.

More specifically, the invention provides a mouthpiece to facilitate direct human consumption of liquid from a narrow-necked container, such as a bottle having a mouth defined by a peripheral rim that in use is enclosed by the lips of the consumer, said mouthpiece comprising, a tubular body having a mounting section adapted to engage the peripheral rim of the bottle mouth and form an annular seal therewith; an adjoining extension that defines an annular wall projecting axially away from said mounting section to surround the container adjacent its mouth and terminating in a smooth annular free end; and vent passage means formed in said mouthpiece communicating between an interior outlet receiving a tube for opening to the interior of the container, and an exterior inlet located on the surface of the mouthpiece at a position spaced from said free end by a distance sufficient to ensure that in use said inlet will not be blocked by the lips of the consumer and air can pass therethrough to the interior of the container to replace the liquid being consumed.

Preferably the mouthpiece has a body formed of a relatively stiff moulded plastics material, the distal end (i.e. the end to be engaged by the lips of the consumer) having a configuration similar to that of a bottle. A compliant resilient insert is positioned within the extension of the mouthpiece to surround and engage the rim of the bottle and form a seal therewith. Passage means is defined in the mouthpiece, e.g. in the form of channels formed between the insert and the casing, to lead air from the end of the mouthpiece opposite to the end engaged by the lips, to a passage structure leading to a tube through which air can be fed to the interior of the bottle.

BRIEF DESCRIPTION OF THE DRAWINGS

The invention will further be described, by way of example only, with reference to the accompanying drawings wherein.

BRIEF DESCRIPTION OF THE PREFERRED EMBODIMENTS

Figure 1:
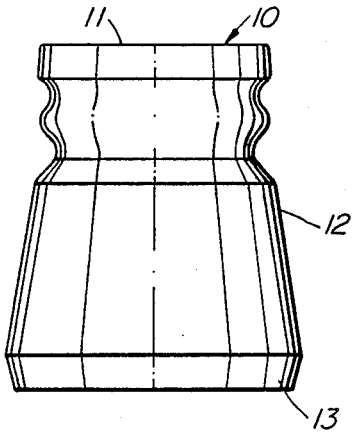
FIG. 1 is a view in elevation of a preferred form of mouthpiece in accordance with the invention.
Figure 2:
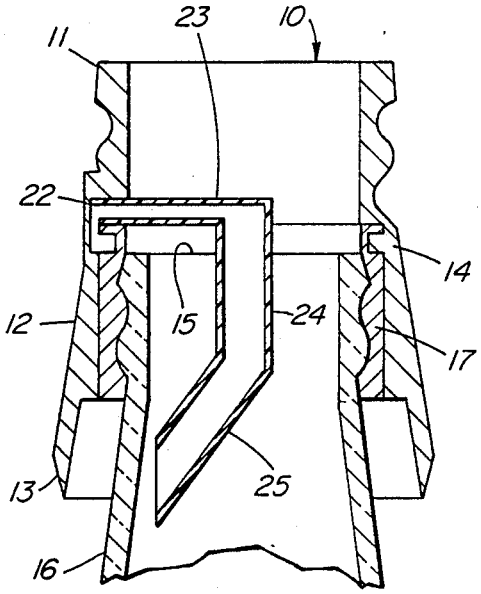
FIG. 2 is a sectional elevational view of the mouthpiece of FIG. 1, drawn to an enlarged scale.
Figure 5:
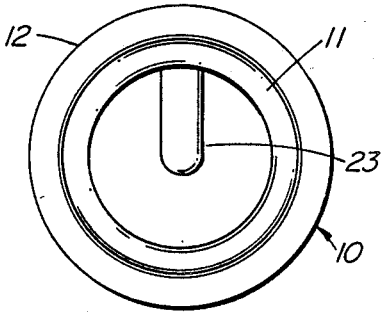
FIG. 5 is a plan view of the mouthpiece of FIG. 1.

As seen in FIG. 1, the mouthpiece 10 is a generally smooth surfaced figure of revolution, being of annular form having an upper end 11 of a configuration simulating that of the mouth of a bottle, e.g. as used for bottling soft drinks or beer. As best seen in FIG. 2, the upper end 11 is relatively thick walled and is integral with a conically flared thin walled skirt 12 having an inwardly bevelled section 13 at its lower end. Between the upper end 11 and the skirt 12, the mouthpiece includes a mounting section 14 by means of which it is adapted to be attached to the mouth 15 of a bottle or similar container 16. The mouthpiece 10 is made of a relatively stiff plastics material, specifically a material that is approved for use with foodstuffs and beverages, and the skirt 12 encloses an insert 17 that is made of a relatively resilient plastic or rubber material, also of a quality approved for use with food and beverages.

Figure 3:
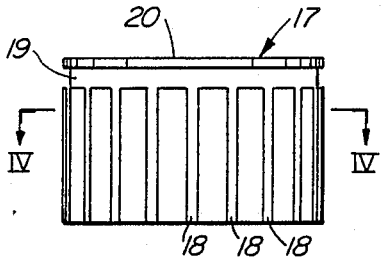
FIG. 3 is an elevational view of an insert used in the mouthpiece.
Figure 4:
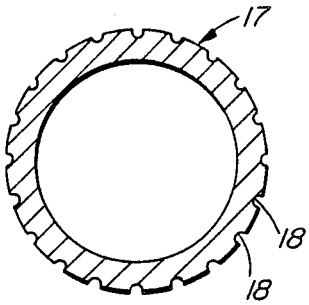
FIG. 4 is a sectional view of the insert taken on the line IV—IV in FIG. 3.

The insert 17 is more clearly seen in FIGS. 3 and 4, and is of thick walled tubular configuration, in its free state being generally cylindrical and having on its outer surface a series of axially extending slots 18. As shown, the insert includes 20 slots, but of course this number can be varied as desired. The slots lead from the lower end of the insert and terminate in a common annular groove 19, the groove being bounded on its upper side by a peripheral lip 20.

When positioned within the skirt 12, the outer surface of the insert 17 assumes the taper of the skirt, and the groove 19 is positioned within the mounting section 14 and is closed by the wall of the skirt to define an annular passage. At one location this annular passage opens into an enlarged chamber 22 in the wall of the upper end 11 of the mouthpiece. An L-shaped pipe 23 is mounted within the mouthpiece as shown in FIG. 2 and has its interior in communication with the chamber 22. The pipe 23 terminates in a section 24 that is directed towards the interior of the bottle, and can be adapted to receive a straw 25 or the like to form an extension of the pipe passage reaching towards the bottom of the bottle.

When the mouthpiece is installed on the mouth and neck of the bottle as seen in FIG. 3, the insert 17 is deformed to conform to and seal against the portions of the bottle adjacent to its mouth 15, and thus form a liquid tight seal therewith. The slots 18 define with the confronting wall of the skirt 12 vent passage means leading from the vicinity of the lower end of the skirt to the annular groove 19, and thence via the chamber 22 and the pipe 23 to the interior of the bottle. The inwardly bevelled section 13 of the skirt 12 terminates relatively close to the surface of the bottle 16 so that these vent passage means are effectively hidden.

In use, when the mouthpiece 10 is installed as in FIG. 2, to drink from the bottle, the consumer places his lips around the upper end 11 and inverts the bottle. It will be appreciated that as liquid flows from the bottle it is replaced by air passing through the vent passage means and the pipe 23 (and the straw 25 if present) to the interior of the bottle. Thus the flow of liquid from the bottle is assisted, and it is not necessary for the consumer to remove his lips from the bottle to allow entry of air to replace the liquid consumed. It will be noted that the location where air enters the vent passage means 18 is at the opposite end of the mouthpiece from the end engaged by the user. Thus there is no likelihood that the inlet to the vent passages could be blocked by the lips of the user.

Figure 6:
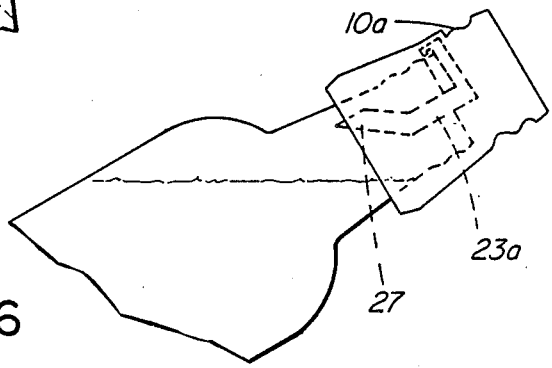
FIG. 6 is a somewhat schematic view showing an alternative form of the mouthpiece.

A slightly modified configuration is shown in FIG. 6 wherein the mouthpiece **10*a* has a pipe section 23*a* that is of resilient material, and is not designed to accept a straw 25 or the like, but rather has an angled end section 27 directed outwardly so that in use it terminates quite close to the surface of the neck of the bottle with this configuration, to operate effectively the bottle should be oriented so that the end section 27** in use is directed generally upwardly.

I claim:

1. A mouthpiece to facilitate direct human consumption of liquid from a narrow-necked container, such as a bottle having a mouth defined by a peripheral rim that in use is enclosed by the lips of the consumer, said mouthpiece comprising:

a tubular body having a mounting section adapted to engage the peripheral rim of the bottle mouth and form an annular seal therewith;

an adjoining extension that defines an annular wall projecting axially away from said mounting section to surround the container adjacent its mouth, the annular wall encompassing the same diameter as the mouth of the container to allow for unrestricted liquid flow, and terminating in a smooth annular free end;

and vent passage means formed in said mouthpiece communicating between an interior outlet receiving a tube for opening to the interior of the container, and an exterior inlet located on the surface of the mouthpiece at a position spaced from said free end by a distance sufficient to ensure that in use said inlet will not be blocked by the lips of the consumer and air can pass therethrough to the interior of the container to replace the liquid being consumed.

2. A mouthpiece according to claim 1 wherein said mounting section is adapted to engage around the outer surface of the peripheral rim of the bottle mouth and is of compliant resilient material that adapt readily to the form of said outer surface.

3. A mouthpiece according to claim 2 comprising a body formed of a rigid moulded plastics material, said mounting section including an insert fabricated in a resilient material that can readily deform to receive the bottle rim therein and form the annular seal therewith.

4. A mouthpiece according to claim 3 wherein said mounting section comprises a thin annular skirt integral with said extension and depending therefrom and surrounding said insert.

5. A mouthpiece according to claim 4 wherein said vent passage means is defined in part between said insert and said skirt, said outlet being in the vicinity of the lower end of the skirt.

6. A mouthpiece according to claim 5 wherein said insert is formed with a series of axially extending grooves on the outer surface thereof opening from one end of the insert and leading to an annular groove adjacent its other end said axial and annular grooves being formed into passages by complementary surfaces defined in said body.

7. A mouthpiece according to claim 5 wherein said skirt extends beyond the end of said insert and has an end section that is convergent so that in use the inlet of the vent passage means is shielded.

* * * * *